US009486842B2

(12) United States Patent
Yao et al.

(10) Patent No.: US 9,486,842 B2
(45) Date of Patent: Nov. 8, 2016

(54) ULTRAVIOLET LIGHT BASED CLEANSING METHOD AND CLEANSING DEVICE

(71) Applicant: Shenzhen China Star Optoelectronics Technology Co., Ltd., Shenzhen, Guangdong (CN)

(72) Inventors: Jiangbo Yao, Shenzhen (CN); Chunliang Lee, Shenzhen (CN)

(73) Assignee: Shenzhen China Star Optoelectronics Technology Co., Ltd, Shenzhen, Guangdong (CN)

( * ) Notice: Subject to any disclaimer, the term of this patent is extended or adjusted under 35 U.S.C. 154(b) by 355 days.

(21) Appl. No.: 14/118,231

(22) PCT Filed: Aug. 29, 2013

(86) PCT No.: PCT/CN2013/082506

§ 371 (c)(1),
(2) Date: Nov. 17, 2013

(87) PCT Pub. No.: WO2015/024276

PCT Pub. Date: Feb. 26, 2015

(65) Prior Publication Data

US 2015/0144153 A1 May 28, 2015

(30) Foreign Application Priority Data

Aug. 23, 2013 (CN) ..... 2013 1 0372881

(51) Int. Cl.

| | |
|---|---|
| ***B08B 7/04*** | (2006.01) |
| ***B08B 3/08*** | (2006.01) |
| ***B08B 7/00*** | (2006.01) |
| ***B08B 3/02*** | (2006.01) |
| ***B08B 3/04*** | (2006.01) |

(52) U.S. Cl.

CPC ..... *B08B 7/0057* (2013.01); *B08B 3/022* (2013.01); *B08B 3/041* (2013.01); *B08B 3/08* (2013.01); *B08B 7/04* (2013.01)

(58) Field of Classification Search

CPC ..... B08B 3/041; B08B 3/024; B08B 5/00; B08B 5/02; B08B 5/023; B08B 5/026; B08B 7/0035; B08B 7/0057; B08B 7/04; B08B 3/022; B08B 3/08; B08B 5/025; H01L 21/02046; H01L 21/02052; H01L 21/02054

USPC ..... 134/1, 1.3

See application file for complete search history.

(56) References Cited

U.S. PATENT DOCUMENTS

| | | | | |
|---|---|---|---|---|
| 5,669,979 | A | 9/1997 | Elliott et al. | |
| 6,896,744 | B2 * | 5/2005 | Morinaga | B08B 3/08 134/2 |
| 2005/0034742 | A1 | 2/2005 | Saito et al. | |

FOREIGN PATENT DOCUMENTS

| | | | |
|---|---|---|---|
| CN | 1947871 | A | 4/2007 |
| CN | 101566902 | A | 10/2009 |
| CN | 10156690210-2009 | * | 10/2009 |

(Continued)

*Primary Examiner* — Saeed T Chaudhry

(74) *Attorney, Agent, or Firm* — Andrew C. Cheng

(57) ABSTRACT

The present invention provides an ultraviolet light based cleansing method and cleansing device. The method includes: (1) irradiating a substrate to be cleansed with ultraviolet light and controlling output energy of the ultraviolet light in order to control photon energy received by TFT component patterns formed on the substrate to be cleansed within an irradiation time period to be less than electron excitation energy that breaks down TFT component patterns; (2) cleansing the substrate to be cleansed with an alkaline solution; (3) cleansing the substrate to be cleansed with water/gas dual-fluid; (4) cleansing the substrate to be cleansed with deionized water; (5) drying the substrate to be cleansed with an air knife; and (6) subjecting the substrate to be cleansed to dehydration and drying to complete the cleansing operation, thereby improving product yield rate and cleanness.

5 Claims, 4 Drawing Sheets

(56) References Cited

FOREIGN PATENT DOCUMENTS

| | | | |
|---|---|---|---|
| CN | 103008311 | * | 4/2013 |
| CN | 103008311 | A | 4/2013 |
| EP | 2177278 | A1 | 4/2010 |
| JP | 1998050646 | * | 2/1998 |
| JP | 1998050646 | A | 2/1998 |

* cited by examiner

ULTRAVIOLET LIGHT BASED CLEANSING METHOD AND CLEANSING DEVICE

BACKGROUND OF THE INVENTION

1. Field of the Invention

The present invention relates to the field of display device manufacture, and in particular to an ultraviolet light based cleansing method and cleansing device.

2. The Related Arts

A flat panel display has various advantages, including thin device body, low power consumption, and being free of radiation, and is thus widely used. The flat panel displays that are currently available generally include liquid crystal displays (LCDs) and organic light emitting displays (OLEDs).

Referring to FIG. 1, a conventional liquid crystal display generally comprises: a thin-film transistor (TFT) substrate 302, a color filter (CF) substrate 304 that is opposite to and is bonded to the TFT substrate 302, and a liquid crystal layer 306 interposed between the TFT substrate 302 and the CF substrate 304. The TFT substrate 302 drives the liquid crystal molecules of the liquid crystal layer 306 to rotate in order to display a corresponding image.

The conventional organic light emitting displays are classified according to the method of driving applied and include passive-matrix organic light emitting diode (PMOLED) and active-matrix organic light emitting device (AMOLED), wherein, as shown in FIG. 2, the AMOLED generally comprises: a substrate 502, a TFT 504 formed on the substrate 502, and an organic light-emitting diode 506 formed on the TFT 504. The TFT 504 drives the organic light-emitting diode 506 to emit light in order to display a corresponding image.

In a manufacturing process of the substrate, cleansing operations take 30%-40% of the total workload and the requirement for cleanness is extremely severe. Heretofore, there are generally two types of fine cleansing technique, one being dry cleansing technique and the other being wet cleansing technique. The wet cleansing is further divided into chemical cleansing and physical cleansing. The currently available chemical cleansing cannot meet the requirements and the shortcoming of the wet cleansing is the use of a great amount of pure water and toxicant chemical solvents in a cleansing operation, this readily resulting in hazards to the operators and environmental pollutions.

Ultraviolet (UV) light surface cleansing techniques are non-contact high-cleanness dry surface treatment techniques, of which the feature is the cleanness after the cleansing can achieve an atomic grade and which uses light and gas to completely remove all sorts of organic substances attached to a glass surface. Since no direct contact with the surface is made, there is no damage to the substrate surface. Further, no environmental pollution is caused.

The general principle of ultraviolet light cleansing is that an UV light source emits light waves having wavelengths of 185 nm and 254 nm, which carry extremely high energy. When the photons are applied to a surface of an object to be cleansed, due to the fact that most of the hydrocarbons have relatively high absorbability of ultraviolet light of 185 nm wavelength and can be decomposed into ions, free atoms, excited molecules and neutrons after absorbing the energy of the 185 nm wavelength ultraviolet light; this is generally referred to as photosensitization. Oxygen molecules contained in the atmosphere, after absorbing the 185 nm wavelength ultraviolet light, will also generate ozone and atomic oxygen. Ozone has strong absorption of the 254 nm wavelength ultraviolet light and ozone will further decompose into atomic oxygen and oxygen gas, of which the atomic oxygen is extremely active so that being acted on thereby, the decomposed components of carbons and hydrocarbons on the surface of the object can be combined to form volatile gases: carbon dioxide and steam to escape from the surface thereby completely eliminating carbons and organic contaminants attached to the surface of the object.

In the conventional OLED and low temperature polysilicon (LTPS) techniques, equivalent ultraviolet (EUV) cleansing applied in a TFT manufacture process uses ultraviolet light of 172 nm wavelength. During the cleansing process, the ultraviolet light irradiating a metal electrode causes excitation of electrons, leading to a potential difference between metal patterns. When the potential difference exceeds the breakdown voltage of the patterns, a circuit breakdown may result, leading to un-repairable damage and thus affecting product yield rate.

SUMMARY OF THE INVENTION

An object of the present invention is to provide an ultraviolet light based cleansing method, which has high cleanness and can avoid circuit breakdown during the ultraviolet light cleansing thereby improving product yield rate.

Another object of the present invention is to provide an ultraviolet light based cleansing device, which has a simple structure, is easy to operate, has high cleanness, and can effectively improve product yield rate.

To achieve the objective, the present invention provides an ultraviolet light based cleansing method, which comprises the following steps:

(1) irradiating a substrate to be cleansed with ultraviolet light and controlling output energy of the ultraviolet light in order to control photon energy received by TFT component patterns formed on the substrate to be cleansed within an irradiation time period to be less than electron excitation energy that breaks down TFT component patterns;

(2) cleansing the substrate to be cleansed with an alkaline solution;

(3) cleansing the substrate to be cleansed with water/gas dual-fluid;

(4) cleansing the substrate to be cleansed with deionized water;

(5) drying the substrate to be cleansed with an air knife; and (6) subjecting the substrate to be cleansed to dehydration and drying to complete the cleansing operation.

The ultraviolet light has a wavelength of 172 nm and the ultraviolet light has an output energy less than or equal to 130 mj/cm$^2$.

The alkaline solution is tetramethylammonium hydroxide solution.

Mass concentration of tetramethylammonium hydroxide of the tetramethylammonium hydroxide solution is 0.4%-2.38%.

The present invention also provides an ultraviolet light based cleansing method, which comprises the following steps:

(1) irradiating a substrate to be cleansed with ultraviolet light and controlling output energy of the ultraviolet light in order to control photon energy received by TFT component patterns formed on the substrate to be cleansed within an irradiation time period to be less than electron excitation energy that breaks down TFT component patterns;

(2) cleansing the substrate to be cleansed with an alkaline solution;

(3) cleansing the substrate to be cleansed with water/gas dual-fluid;

(4) cleansing the substrate to be cleansed with deionized water;

(5) drying the substrate to be cleansed with an air knife; and (6) subjecting the substrate to be cleansed to dehydration and drying to complete the cleansing operation;

wherein the ultraviolet light has a wavelength of 172 nm and the ultraviolet light has an output energy less than or equal to 130 mj/cm$^2$.

The alkaline solution is tetramethylammonium hydroxide solution.

Mass concentration of tetramethylammonium hydroxide of the tetramethylammonium hydroxide solution is 0.4%-2.38%.

The present invention further provides an ultraviolet light based cleansing device, which comprises:

a conveyance device, which functions to carry and convey a substrate to be cleansed;

an ultraviolet light emission device, which is located above the conveyance device to emit ultraviolet light having a wavelength of 172 nm to the substrate to be cleansed, wherein the ultraviolet light having the wavelength of 172 nm has an output energy less than or equal to 130 mj/cm$^2$;

a first spraying device, which is located above the conveyance device and is located at one side of the ultraviolet light emission device to spray an alkaline solution to the substrate to be cleansed;

a sprinkling device, which is located above the conveyance device and is located at one side of the first spraying device that is distant from the ultraviolet light emission device to sprinkle water/gas dual-fluid to the substrate to be cleansed;

a second spraying device, which is located above the conveyance device and located at one side of the sprinkling device that is distant from the first spraying device to spray deionized water to the substrate to be cleansed;

an air-blowing device, which is located above the conveyance device and located at one side of the second spraying device that is distant from the sprinkling device to blow air to the substrate to be cleansed; and a drying device, which is located above the conveyance device and located at one side of the air-blowing device that is distant from the second spraying device to heat and dry the substrate to be cleansed.

The ultraviolet light emission device comprises an ultraviolet lamp.

The alkaline solution is tetramethylammonium hydroxide solution.

Mass concentration of tetramethylammonium hydroxide of the tetramethylammonium hydroxide solution is 0.4%-2.38%.

The air-blowing device comprises an air knife.

The drying device comprises a heat plate.

The efficacy of the present invention is that the present invention provides an ultraviolet light based cleansing method and cleansing device, wherein an input energy of ultraviolet light is controlled in such a way that a potential difference induced by metal electrons generated in a unit time is made less than a breakdown voltage in order to protect a TFT circuit and to improve product yield rate and wherein a weakly alkaline solution is used to cleanse the substrate that has been irradiated to achieve sufficient decomposition of organic substances and effectively improve cleanness.

For better understanding of the features and technical contents of the present invention, reference will be made to the following detailed description of the present invention and the attached drawings. However, the drawings are provided for the purposes of reference and illustration and are not intended to impose undue limitations to the present invention.

BRIEF DESCRIPTION OF THE DRAWINGS

The technical solution, as well as other beneficial advantages, of the present invention will be apparent from the following detailed description of an embodiment of the present invention, with reference to the attached drawings. In the drawings.

DETAILED DESCRIPTION OF THE PREFERRED EMBODIMENTS

To further expound the technical solution adopted in the present invention and the advantages thereof, a detailed description is given to a preferred embodiment of the present invention and the attached drawings.

Figure 1:
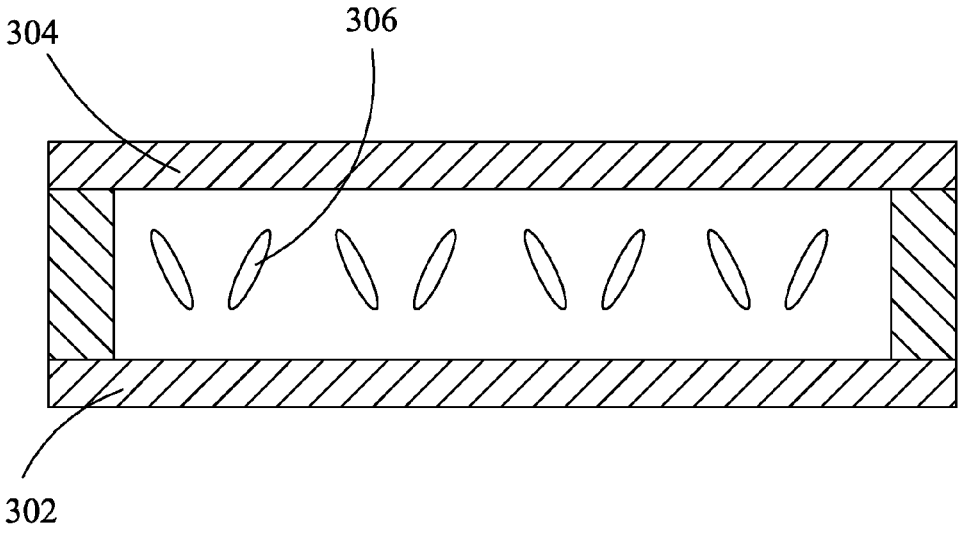
FIG. 1 is a schematic view showing a conventional liquid crystal display panel.
Figure 2:
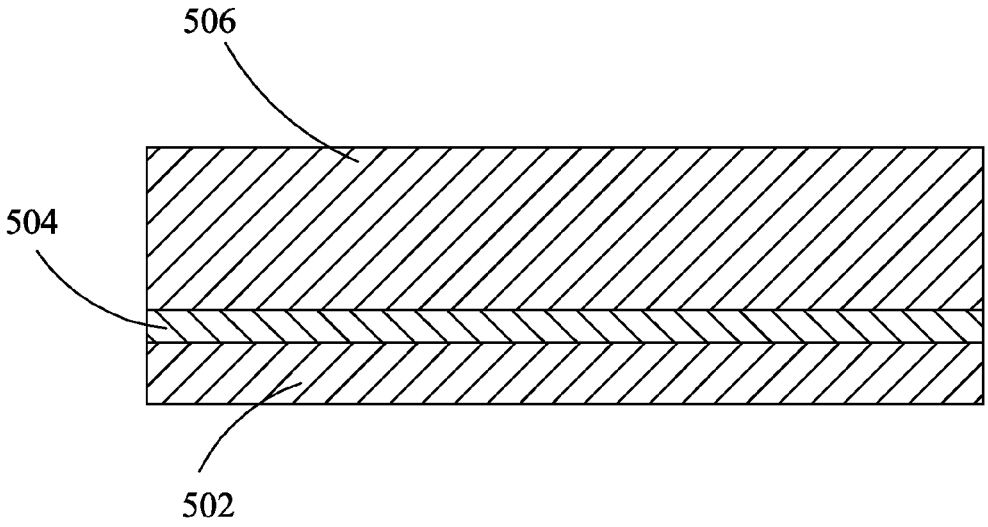
FIG. 2 is a schematic view showing a conventional active-matrix organic light emitting display.
Figure 3:
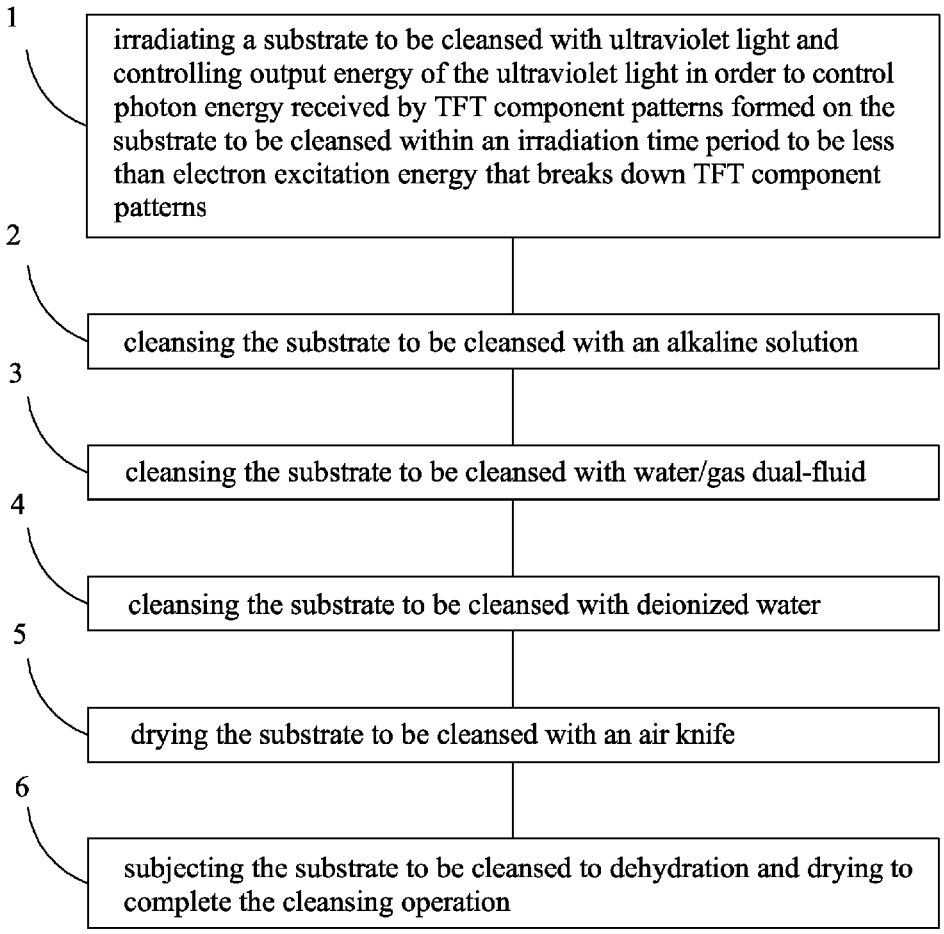
FIG. 3 is a flow chart illustrating an ultraviolet light based cleansing method according to the present invention.

Referring to FIG. 3, the present invention provides an ultraviolet light based cleansing method, which comprises the following steps:

Step 1: irradiating a substrate to be cleansed with ultraviolet light and controlling output energy of the ultraviolet light in order to control the photon energy received by TFT component patterns formed on the substrate to be cleansed within an irradiation time period to be less than electron excitation energy that breaks down TFT component patterns.

The ultraviolet light used has a wavelength of 172 nm and the ultraviolet light has a predetermined level of output energy that is 130 mj/cm$^2$. The present invention uses 172 nm ultraviolet light to irradiate the substrate to decompose organic contaminant existing on the substrate. Analysis the process of generation of electron in the ultraviolet light cleansing operation reveals that the conventionally used 172 nm ultraviolet light has a short wavelength and intense energy, which may readily cause excitation of electrons of metal so as to induce a potential difference, namely a voltage, between the TFT component patterns. Once the voltage so induced exceeds a tolerable range between the TFT component patterns, breakdown of the TFT circuit pattern will result.

The excitation of electrons induces a voltage between the TFT circuit patterns, $U=Q/C$, $C=\in S/d$, namely $U=Qd/\in S$ (where Q is electron excitation energy of the patterns, d is the distance between the patterns, S is the front surface area of the patterns, and $\in$ is metal dielectric constant). According to the above-described electronic theory, it is known that when the voltage induced between circuit patterns spaced by a predetermined distance and having a predetermined area by metal electrons excited by ultraviolet light in a unit time is less than the breakdown voltage of the circuit patterns, there will be definitely no breakdown damage.

According to the light illuminance and energy formulas: luminous energy=illuminance*time and illuminance=power*luminous efficacy/illumination area, it is known that reducing illuminance of the ultraviolet light could reduce the photon energy absorbed in a unit time, namely the number of electrons excited, so that it is possible to control the amount of electricity excited in a unit time by controlling the input power of an ultraviolet lamp in order to avoid breakdown between circuit patterns. Generally, the output energy of the ultraviolet light is controlled to be less than 130 mj/cm$^2$ in order to avoid occurrence of breakdown between circuit patterns.

Step 2: cleansing the substrate to be cleansed with an alkaline solution.

After being irradiated by the 172 nm ultraviolet light, the organic substances on the substrate are decomposed into weakly acidic compounds and gases. Adding a process of cleansing with a weakly alkaline solution after the irradiation of ultraviolet light could clear off minor acidic substances of carbonic acid, nitric acid, and sulfuric acid that are generated by the decomposition of the organic substances irradiated with high-energy ultraviolet light.

The alkaline solution is tetramethylammonium hydroxide solution. The mass concentration of tetramethylammonium hydroxide in the tetramethylammonium hydroxide solution is 0.4%-2.38%.

Step 3: cleansing the substrate to be cleansed with water/gas dual-fluid.

This can be done with known techniques and the principle is that with liquid being atomized with high speed flow of compressed air, when droplets of the cleansing liquid impact a surface of the substrate to be cleansed, shock waves and expansion waves generated inside the droplets with the centers being at contact points between the droplets and the substrate to be cleansed could further form a jet stream that could rinse the surface of the substrate to be cleansed. When the droplets directly flush ultrafine particles, pressure variation inside the droplets may peel the ultrafine particles off the surface of the substrate to be cleansed. If the droplets could not immediately flush away the ultrafine particles, the jet stream may then flush away the ultrafine particles so as to achieve cleansing of the substrate to be cleansed.

Step 4: cleansing the substrate to be cleansed with deionized water.

This can be done with known techniques and can provide additional flushing to the substrate to improve cleanness.

Step 5: drying the substrate to be cleansed with an air knife.

This can be done with known techniques by blowing air to dry the liquid attached to the substrate.

Step 6: subjecting the substrate to be cleansed to dehydration and drying to complete the cleansing operation.

This can be done with known techniques and generally, heating drying is applied to evaporate the liquid remaining on the substrate after the air knife drying in order to achieve drying of the substrate.

Figure 4:
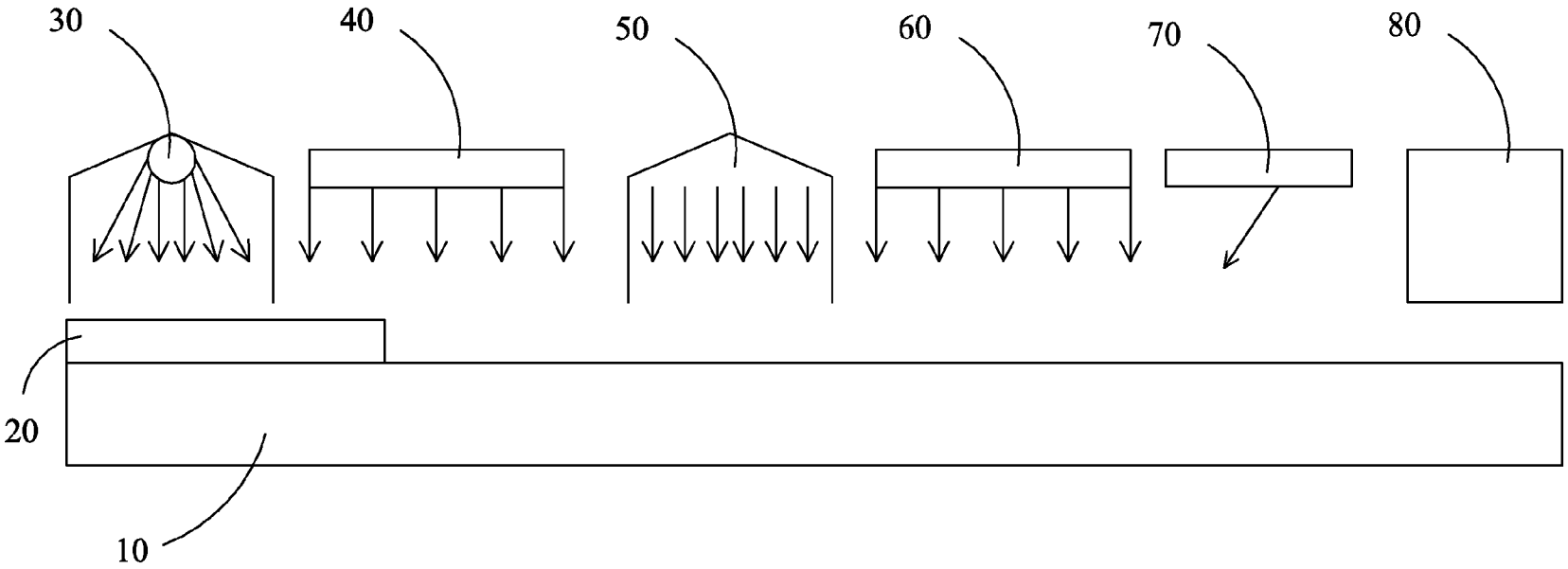
FIG. 4 schematically illustrates an operation flow of an ultraviolet light based cleansing device according to the present invention.

Referring to FIG. 4, the present invention further provides an ultraviolet light based cleansing device, which comprises the following components:

a conveyance device 10, which is provided for carrying and conveying a substrate to be cleansed 20;

an ultraviolet light emission device 30, in the instant embodiment, the ultraviolet light emission device 30 being an ultraviolet lamp located above the conveyance device 10 to emit ultraviolet light having a wavelength of 172 nm to the substrate to be cleansed 20, wherein input power of the ultraviolet lamp is controlled to control illuminance of the lamp so as to control the electricity excited in a unit time and thus avoiding breakdown between circuit patterns and generally, the output energy of the ultraviolet light is controlled to be less than 130 mj/cm$^2$ in order to avoid the occurrence of breakdown between circuit patterns;

a first spraying device 40, which is located above the conveyance device 10 and is located at one side of the ultraviolet light emission device 30 to spray an alkaline solution to the substrate to be cleansed 20;

wherein after being irradiated by the 172 nm ultraviolet light, the organic substances on the substrate are decomposed into weakly acidic compounds and gases and adding a process of cleansing with a weakly alkaline solution after the irradiation of ultraviolet light could clear off minor acidic substances of carbonic acid, nitric acid, and sulfuric acid that are generated by the decomposition of the organic substances irradiated with high energy ultraviolet light; and the alkaline solution is tetramethylammonium hydroxide solution and the mass concentration of tetramethylammonium hydroxide in the tetramethylammonium hydroxide solution is 0.4%-2.38%;

a sprinkling device 50, which is located above the conveyance device 10 and is located at one side of the first spraying device 40 that is distant from the ultraviolet light emission device 30 to sprinkle water/gas dual-fluid to the substrate to be cleansed 20;

a second spraying device 60, which is located above the conveyance device 10 and located at one side of the sprinkling device 50 that is distant from the first spraying device 40 to spray deionized water to the substrate to be cleansed 20;

an air-blowing device 70, in the instant embodiment, the air-blowing device 70 being an air knife, which is located above the conveyance device 10 and located at one side of the second spraying device 60 that is distant from the sprinkling device 50 to blow air to the substrate to be cleansed 20; and a drying device 80, in the instant embodiment, the drying device 80 being a heat plate, which is located above the conveyance device 10 and located at one side of the air-blowing device 70 that is distant from the second spraying device 60 to heat and dry the substrate to be cleansed 20.

In summary, the present invention provides an ultraviolet light based cleansing method and cleansing device, wherein an input energy of ultraviolet light is controlled in such a way that a potential difference induced by metal electrons generated in a unit time is made less than a breakdown voltage in order to protect a TFT circuit and to improve product yield rate and wherein a weakly alkaline solution is used to cleanse the substrate that has been irradiated to achieve sufficient decomposition of organic substances and effectively improve cleanness.

Based on the description given above, those having ordinary skills of the art may easily contemplate various changes and modifications of the technical solution and technical ideas of the present invention and all these changes and modifications are considered within the protection scope of right for the present invention.

What is claimed is:

1. An ultraviolet light based cleansing method, comprising the following steps:

(1) irradiating a substrate to be cleansed with ultraviolet light having a wavelength of 172 nm and controlling output energy of the ultraviolet light to be less than or equal to 130 mj/cm$^2$ in order to control photon energy received by thin-film transistor (TFT) component patterns formed on the substrate to be cleansed within an irradiation time period to be less than electron excitation energy that breaks down TFT component patterns;

(2) cleansing the substrate to be cleansed with an alkaline solution;

(3) cleansing the substrate to be cleansed with water/gas dual-fluid;

(4) cleansing the substrate to be cleansed with deionized water;

(5) drying the substrate to be cleansed with an air knife; and (6) subjecting the substrate to be cleansed to dehydration and drying to complete the cleansing operation.

2. The ultraviolet light based cleansing method as claimed in claim 1, wherein the alkaline solution is tetramethylammonium hydroxide solution.

3. The ultraviolet light based cleansing method as claimed in claim 2, wherein mass concentration of tetramethylammonium hydroxide of the tetramethylammonium hydroxide solution is 0.4%-2.38%.

4. The ultraviolet light based cleansing method as claimed in claim 1, wherein mass concentration of tetramethylammonium hydroxide of the tetramethylammonium hydroxide solution is 0.4%-2.38%.

5. An ultraviolet light based cleansing method, comprising the following steps:

(1) irradiating a substrate to be cleansed with ultraviolet light having a wavelength of 172 nm and controlling output energy of the ultraviolet light to be less than or equal to 130 mj/cm$^2$ in order to control photon energy received by thin-film transistor (TFT) component patterns formed on the substrate to be cleansed within an irradiation time period to be less than electron excitation energy that breaks down TFT component patterns;

(2) cleansing the substrate to be cleansed with an alkaline solution comprising tetramethylammonium hydroxide solution;

(3) cleansing the substrate to be cleansed with water/gas dual-fluid;

(4) cleansing the substrate to be cleansed with deionized water;

(5) drying the substrate to be cleansed with an air knife; and (6) subjecting the substrate to be cleansed to dehydration and drying to complete the cleansing operation.

* * * * *